US008251560B2

(12) United States Patent
Ohno et al.

(10) Patent No.: US 8,251,560 B2
(45) Date of Patent: Aug. 28, 2012

(54) VEHICLE HEADLIGHT

(75) Inventors: Masafumi Ohno, Tokyo (JP); Ryotaro Owada, Tokyo (JP); Norikatsu Myojin, Tokyo (JP)

(73) Assignee: Stanley Electric Co., Ltd., Tokyo (JP)

( * ) Notice: Subject to any disclaimer, the term of this patent is extended or adjusted under 35 U.S.C. 154(b) by 352 days.

(21) Appl. No.: 12/720,819

(22) Filed: Mar. 10, 2010

(65) Prior Publication Data

US 2010/0232173 A1 Sep. 16, 2010

(30) Foreign Application Priority Data

Mar. 11, 2009 (JP) ..... 2009-058188

(51) Int. Cl.
*F21V 8/10* (2006.01)

(52) U.S. Cl. ..... 362/545; 362/311.02; 362/509

(58) Field of Classification Search ..... 362/509, 362/520–522, 543–545, 311.06, 311.01, 362/311.02, 311.1
See application file for complete search history.

(56) References Cited

U.S. PATENT DOCUMENTS

| | | | | |
|---|---|---|---|---|
| 4,733,335 | A * | 3/1988 | Serizawa et al. | 362/503 |
| 5,101,326 | A * | 3/1992 | Roney | 362/545 |
| 6,273,596 | B1 * | 8/2001 | Parkyn, Jr. | 362/522 |
| 6,850,001 | B2 * | 2/2005 | Takekuma | 313/501 |
| 7,128,454 | B2 * | 10/2006 | Kim et al. | 362/507 |
| 2005/0068786 | A1 * | 3/2005 | Ishida | 362/509 |
| 2005/0094413 | A1 | 5/2005 | Sazuka et al. | |
| 2005/0219856 | A1 | 10/2005 | Tatsukawa | |
| 2008/0007961 | A1 | 1/2008 | Mochizuki et al. | |

FOREIGN PATENT DOCUMENTS

| | | | |
|---|---|---|---|
| JP | 2005-141919 | A | 6/2005 |
| JP | 2005-294176 | A | 10/2005 |
| JP | 2006-172829 | A | 6/2006 |
| JP | 2007-5182 | A | 1/2007 |
| JP | 2008-13014 | A | 1/2008 |

* cited by examiner

*Primary Examiner* — Julie Shallenberger
(74) *Attorney, Agent, or Firm* — Kenealy Vaidya LLP

(57) ABSTRACT

The disclosed subject matter includes a projector headlight using a plurality of optical units for a low beam with a high visible/visual quality. Each of the optical units can include a plurality of LED devices and a projector lens. The projector lens can include a light-emitting surface including a reflex function and a reflex surface including a light incoming surface that is located on the opposite side of the light-emitting surface. The LED devices can be located adjacent the light incoming surface, and the optical units can be located so that angles between optical axes of adjacent optical units can become substantially a same angle. Thus, the projector headlight can form various favorable light distribution patterns by changing curvature factors of the light-emitting surface and the reflex surface of the projector lens in each of the optical units and by changing the angles between the optical axes of the adjacent optical units.

20 Claims, 15 Drawing Sheets

VEHICLE HEADLIGHT

This application claims the priority benefit under 35 U.S.C. §119 of Japanese Patent Application No. 2009-058188 filed on Mar. 11, 2009, which is hereby incorporated in its entirety by reference.

BACKGROUND

1. Field

The presently disclosed subject matter relates to a vehicle headlight including a projector headlight using LED optical units for a low beam, and more particularly to a vehicle headlight including a projector headlight for a low beam having a favorable light distribution pattern and a high visual/visible quality.

2. Description of the Related Art

Recently, various vehicle headlights using LED optical units have been developed.

This development has been brought about because LEDs have a long life and are battery friendly as compared with a light bulb, discharge lamp, etc. On the other hand, because it is difficult to conform to a light distribution standard for a headlight using one LED chip, vehicle headlights using a plurality of LED optical units have been developed.

A first conventional headlight shown in FIG. 11 is a projector headlight that is disclosed in patent document No. 1 (Japanese Patent Application Laid Open JP2006-172829). The projector headlight is provided with a plurality of projector type optical units 60-63 having a respective optical axis Z60-Z63. Each of the optical units 60-63 can form substantially a same light distribution pattern with respect to each of the optical axes Z60-Z63. A first optical unit 60 is attached to a vehicle so that the optical axis Z60 thereof is located in parallel with a central line of the vehicle. A second optical unit 61 is attached to the vehicle so that the optical axis Z61 thereof intersects with the optical axis Z60 of the first optical unit 60 at a first angle in front of the vehicle. Similarly, third and forth optical units 62, 63 are attached to the vehicle so that their respective optical axes Z62, Z63 intersect with the optical axis Z60 of the first optical unit 60 at a second angle and a third angle, respectively.

In this case, the optical units 60-63 are attached on a circular arc so that the above-described intersection angles become larger in order of the first, second and third angles. Therefore, the projector headlight can be arranged in a small space, and also can emit light along a road including a curved road by controlling light(s) emitted from the optical units 60-63. However, variability in brightness may be caused on a middle portion between the light distribution patterns formed by adjacent optical units. In order to prevent this variability in brightness, it may be necessary to increase the number of the optical units in the first conventional headlight.

In order to provide a favorable light distribution while preventing an increase in the number of the optical units, a second conventional headlight shown in FIG. 12 is disclosed in patent document No. 2 (Japanese Patent Application Laid Open JP2007-5182). The second headlight includes a plurality of projector type optical units 70-74 and a bracket 75 that can rotatably connect the optical units 70-74. Accordingly, the headlight may be applicable to an Adaptive Front-lighting System (AFS), which can change a light-emitting direction and a light distribution pattern according to a travelling circumstance of a vehicle.

However, it is difficult for the above-described conventional headlights to form an elbow line and various cutoff lines for a low beam in their light distribution patterns. With regard to the first conventional headlight, this is because the light distribution pattern among optical units 60-63 is substantially the same. In the second conventional headlight, it may be because each of light distribution patterns formed by the optical units 70-74 changes according to various circumstances.

Patent document No. 3 (Japanese Patent Application Laid Open JP2005-294176) discloses a third conventional headlight that may form various cutoff lines such as a horizontal cutoff line, an elbow line, etc. The third conventional headlight shown in FIG. 13 includes a plurality of optical units 82-86 that are provided with a light-emitting semiconductor device 81 and a reflector for reflecting light emitted from the light-emitting semiconductor device 81. In addition, the headlight includes a cylindrical lens 87 that is located in front of the optical units 82-86 so as to extend along the optical units 82-86 that are located in a horizontal direction.

In this case, first and second optical units 82-83 are located so that both optical axes thereof expand at a predetermined angle in a direction toward light-emission of the headlight and in a horizontal direction. Therefore, these optical units 82-83 can form a light distribution pattern that expands in a direction from an incoming lane toward the outside of a driving lane via the cylindrical lens 87. Other optical units 84-86 can form a light distribution pattern including the horizontal cutoff line and the elbow line via the cylindrical lens 87.

However, in order to form the light distribution pattern it may be necessary to control the light emitted from each of the plurality of optical units 82-86 using the cylindrical lens 87 that is formed as one long lens. Therefore, to form a favorable light distribution pattern, it may be necessary to prepare the above-described optical parts with high accuracy for the third conventional headlight and to adjust the locations of these optical parts.

A fourth conventional headlight including a plurality of optical units that can form a respective individual light distribution pattern is disclosed in patent document No. 4 (Japanese Patent Application Laid Open JP2005-141919). As shown in FIG. 14, the fourth conventional headlight includes a plurality of projector type optical units 90-93 that are located in a horizontal direction and a plurality of reflector type optical units 94-95 that are located under the optical units 91-93. In FIG. 14, only the optical unit 90 is shown. The other optical units 91-93 are not shown in order to show the optical units 94-95.

The optical units 90-93 can form a light distribution pattern including a hot zone, a horizontal cutoff line and an elbow line by combining light emitted from each of the projector type optical units 90-93. The reflector type optical units 94-95 can form a light distribution pattern that expands in a direction from an incoming lane toward the outside of a driving lane under the horizontal cutoff line. Therefore, because each of the optical units 90-95 can form an individual light distribution pattern without light interception, light use efficiency may be improved.

In addition, the fourth conventional headlight may form a favorable light distribution pattern using the combined light emitted from the optical units 90-95. However, the headlight may cause a problem such that power consumption may increase due to the many optical units. Therefore, patent document No. 5 (Japanese Patent Application Laid Open JP2008-13014) discloses a fifth conventional headlight as shown in FIG. 15.

The headlight includes a plurality of projector optical units 50-52 that can form a light distribution pattern including the hot zone, the horizontal line and the elbow line by combining light emitted from each of the optical units 50-52. The headlight also includes a reflector type optical unit 53 which can form a light distribution pattern that expands in a direction from an incoming lane toward the outside of a driving lane under the horizontal cutoff line. In this case, by controlling each amount of light emitted from the optical units 50-53, the headlight may improve visibility on the light distribution pattern while preventing increase of power consumption.

However, the fifth conventional headlight may cause a problem in that the driver circuit may become complex. In addition, the fourth and the fifth conventional headlights are constructed from the projector type optical units and the reflector type optical units, that is, by two different type units. Therefore, the structure may decrease the possible range of headlight design, and also may cause an unspectacular outside appearance.

The above-referenced Patent Documents are listed below and are hereby incorporated with their English abstracts in their entireties.

1. Patent document No. 1: Japanese Patent Application Laid Open JP2006-172829
2. Patent document No. 2: Japanese Patent Application Laid Open JP2007-5182
3. Patent document No. 3: Japanese Patent Application Laid Open JP2005-294176
4. Patent document No. 4: Japanese Patent Application Laid Open JP2005-141919
5. Patent document No. 5: Japanese Patent Application Laid Open JP2008-13014

The disclosed subject matter has been devised to consider the above and other problems, characteristics and features. Thus, an embodiment of the disclosed subject matter can include a vehicle lamp including a projector headlight using projector type optical units for a low beam that can provide a favorable light distribution pattern including a cutoff line and an elbow line with a simple driver circuit. In this case, the projector headlight for a low beam can be constructed only from the projector type optical units that can be formed substantially in a same thin shape. Thus, the projector headlight can result in an increase in the possible range of headlight design and in a high visual quality.

SUMMARY

The presently disclosed subject matter has been devised in view of the above and other characteristics, desires, and problems in the conventional art, and to make certain changes and improvements to existing projector headlights using optical units. An aspect of the disclosed subject matter can include providing a projector headlight using a plurality of optical units for a low beam that can conform to a light distribution standard for headlights and can have a simple structure. Another aspect of the disclosed subject matter can include providing vehicle lamps including the projector headlight using the optical units, wherein the vehicle lamps can be used as projector headlights for a high beam and a low beam with a favorable light distribution pattern and a high visual/visible quality.

According to an aspect of the disclosed subject matter, a projector headlight for a low beam can include a first optical unit, a second optical unit and a third optical unit. Each of the optical units can include an optical axis, a light source and a projector lens, and the projector lens can be provided with a light-emitting surface including a total reflection surface and a reflex surface including a light incoming surface. The light-emitting surface and the reflex surface can be opposite with respect to each other and can be curved in convex shapes having curvature factors. The light source can be made by mounting a plurality of light-emitting devices in line on a base board and can be located adjacent to the light incoming surface of the projector lens so that the light-emitting semiconductor devices face the light incoming surface substantially in a horizontal direction toward a light-emission of the projector headlight.

In addition, the first optical unit can be located so that the optical axis of the first optical unit is directed substantially in a direction toward the light-emission of the projector headlight, the second optical unit can be located adjacent to the first optical unit so that the optical axis thereof is slanted at a first angle with respect to the optical axis of the first optical unit in the opposite direction of the first optical unit, and the third optical unit can be located adjacent to the second optical unit so that the optical axis thereof is slanted at a second angle with respect to the optical axis of the second optical unit in the opposite direction of the second optical unit. In this case, the curvature factors in a horizontal direction toward the light-emission of the projector headlight of the light-emitting surface and the reflex surface of the projector lens in the first optical unit can be smaller than these in the horizontal direction of the light-emitting surface and the reflex surface of the projector lens in the second optical unit, and the curvature factors in the horizontal direction of the light-emitting surface and the reflex surface of the projector lens in the second optical unit can be smaller than those in the horizontal direction of the light-emitting surface and the reflex surface of the projector lens in the third optical unit.

In the above-described exemplary projector headlight, the first angle between the optical axes of the first optical unit and the second optical unit can be the same as the second angle between the optical axes of the second optical unit and third optical unit. Each of the optical axes of the above-described optical units can be located substantially on a same virtual horizontal surface. Each of the light-emitting devices of the light sources in the above-described optical units can also be located substantially on a same virtual horizontal surface. In addition, at least one of the light-emitting surface and the reflex surface in each of the projector lenses in the above-described optical units can include a three dimensional free surface.

According to the above-described exemplary projector headlight, the projector headlights can form various favorable light distribution patterns by changing the curvature factors of the light-emitting surface including the total reflection surface and the reflex surface of the projector lens in each of the optical units and by changing the first and second angles between the optical axes of adjacent optical units with respect to each other. In addition, the projector headlights can allow the optical units to decrease in thickness and can emit light with high brightness and a wide range while forming clear cutoff lines without a glare. Thus, the disclosed subject matter can provide projector headlights for a low beam having a favorable light distribution pattern and a high visual/visible quality.

According to another aspect of the disclosed subject matter, a vehicle lamp including the projector headlight can further include a housing, a projector headlight for a high beam attached to the housing; and an outer lens located adjacent to the housing. Both projector headlights for a low beam and a high beam can be configured with a projector headlight using an LED light source.

In the above-described vehicle lamp including the projector headlight, the vehicle lamp can form favorable light distribution patterns for a low beam and a high beam. Thus, the disclosed subject matter can provide projector headlights for a low beam and a high beam having favorable light distribution patterns and a high visual/visible quality using an LED light source.

BRIEF DESCRIPTION OF THE DRAWINGS

These and other characteristics and features of the disclosed subject matter will become clear from the following description with reference to the accompanying drawings, wherein.

DETAILED DESCRIPTION OF EXEMPLARY EMBODIMENTS

Figure 1:
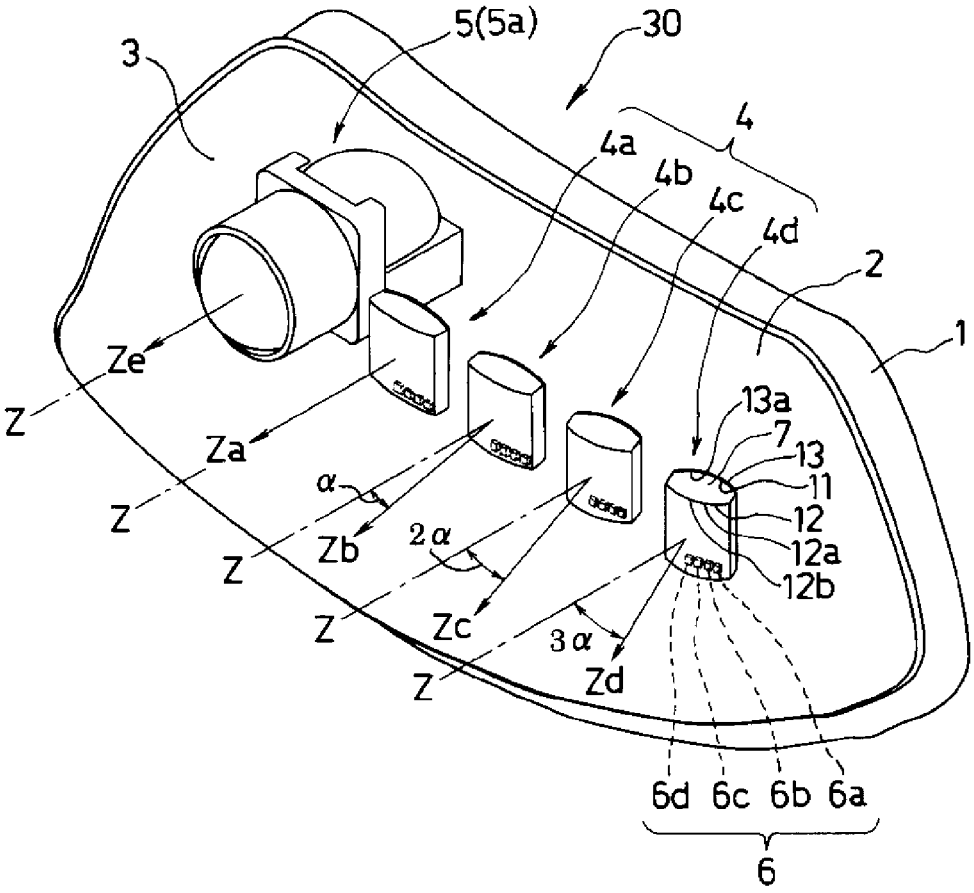
FIG. 1 is a schematic perspective view showing an exemplary embodiment of a projector headlight made in accordance with principles of the disclosed subject matter.

The disclosed subject matter will now be described in detail with reference to FIGS. 1 to 10, in which the same or corresponding elements use the same reference marks. FIG. 1 is a schematic perspective view showing an exemplary embodiment of a projector headlight made in accordance with principles of the disclosed subject matter. The projector headlight 30 is attached to the left side as viewed by a driver and constitutes one of a pair of left/right projector headlights of a vehicle that keeps to the left on a road.

The projector headlight 30 can include the following: a housing 1; a low beam projector lighting unit 4 located in the housing 1; a high beam projector lighting unit 5 located adjacent to the low beam projector lighting unit 4 in the housing 1; and an outer lens covering these projector lighting units 4 and 5 along with the housing 1. The low beam projector lighting unit 4 can be constructed from a first optical unit 4*a*, a second optical unit 4*b*, a third optical unit 4*c* and a fourth optical unit 4*d* each having a respective optical axis Za, Zb, Zc and Zd. The high beam projector lighting unit 5 can be constructed from a fifth optical unit 5*a*, that is, from one optical unit having an optical axis Ze. A plurality of "Z"s shown in FIG. 1 shows a direction toward light-emission of the projector headlight 30, which is substantially perpendicular to a virtual vertical screen 20 shown in FIG. 4 as described in detail later.

Therefore, a low beam light distribution pattern can be formed by these four optical units 4*a*-4*d*. A high beam light distribution pattern can be formed by the projector lighting unit 5, which is constructed from the fifth optical unit 5*a*. Each of the low beam optical units 4*a*-4*d* can include a light source 6 including a plurality of light-emitting semiconductor devices 6*a*-6*d* and a base board so as to mount the plurality of light-emitting devices on the base board. Each of the optical units 4*a*-4*d* can also include a projector lens 7 that controls light emitted from the light source 6 and projects the light in a direction toward the light-emission of the projector headlight 30.

Figure 2:
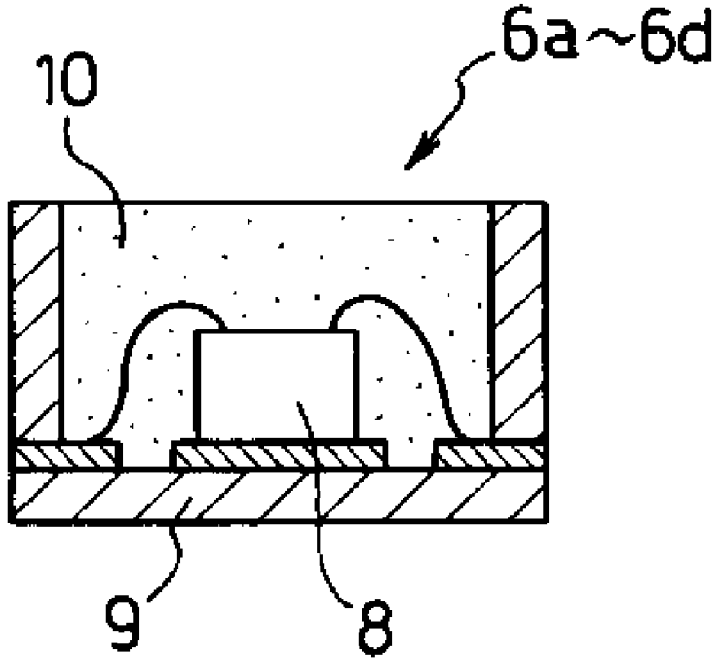
FIG. 2 is a schematic cross-section view showing an exemplary LED device.

The light source 6 can be composed of four LED devices 6*a*-6*d*. Each of these LED devices 6*a*-6*d*, for example as shown in FIG. 2, can include: a casing 9 provided with conductor patterns; an LED (light emitting device) chip 8 that is mounted on the conductor patterns and is electrically connected to the conductor patterns for receiving a power supply; and encapsulating resin 10 disposed in the casing so as to cover the LED chip 8.

A transparent resin such as an epoxy resin, a silicone resin and the like can be used as the encapsulating resin 10. In this case, when a light-emitting color of the LED chip 8 is different from a favorable light-emitting color of the projector headlight 30, a light-emitting color of the LED devices 6*a*-6*d* can be adjusted by dispersing a phosphor or a plurality of phosphors in the encapsulating resin 10.

In FIG. 1, the projector lens 7 can includes three dimensional free surfaces 11 and 12 that are opposite with respect to each other and are curved outward in convex shapes. On the free surface 11, a reflex surface 13*a* having a reflecting layer 13 in which a reflex material such as aluminum and the like is deposited by a method such as a deposition method can be formed. The free surface 12 can include two optical functional surfaces that are a total reflection surface 12*a* and a light-emitting surface 12*b*. Each of curvature factors of these free surfaces 11, 12 can become larger outward in a crosswise direction of the convex shape, which is substantially the same direction as an aligning direction X of the LED devices 6*a*-6*d* described later. Thus, the respective curvature factors of the free surfaces 11, 12 can become larger in the same direction. The projector lens 7 can be composed of a transparent thermoplastic, which includes various materials such as a polycarbonate resin, a metacrylate resin, a cycloolefin resin, and other similar materials that can be used to form the projector lens 7.

Figure 3:
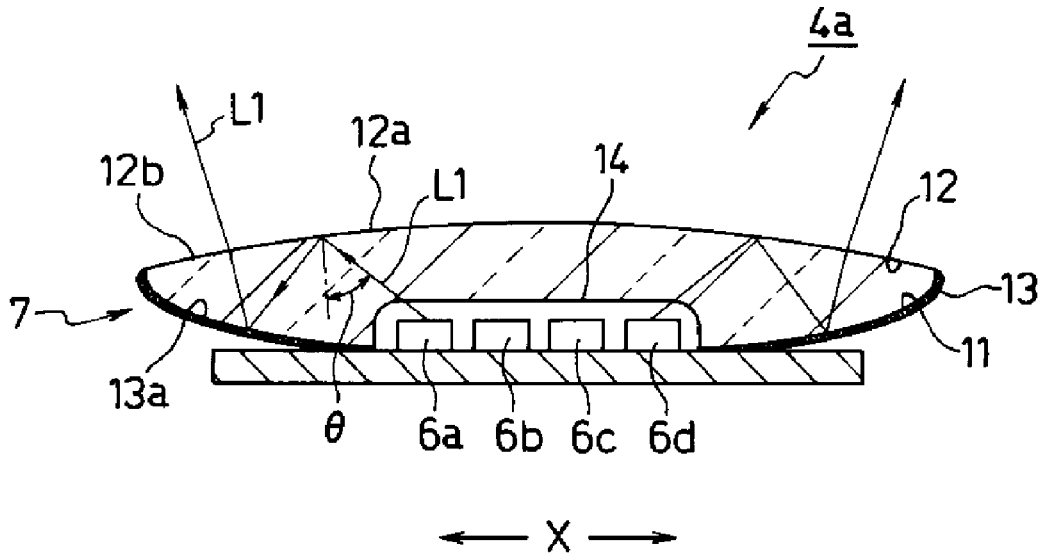
FIG. 3 is an explanatory cross-section view showing an exemplary optical unit used in the projector headlight of FIG. 1.
Figure 4:
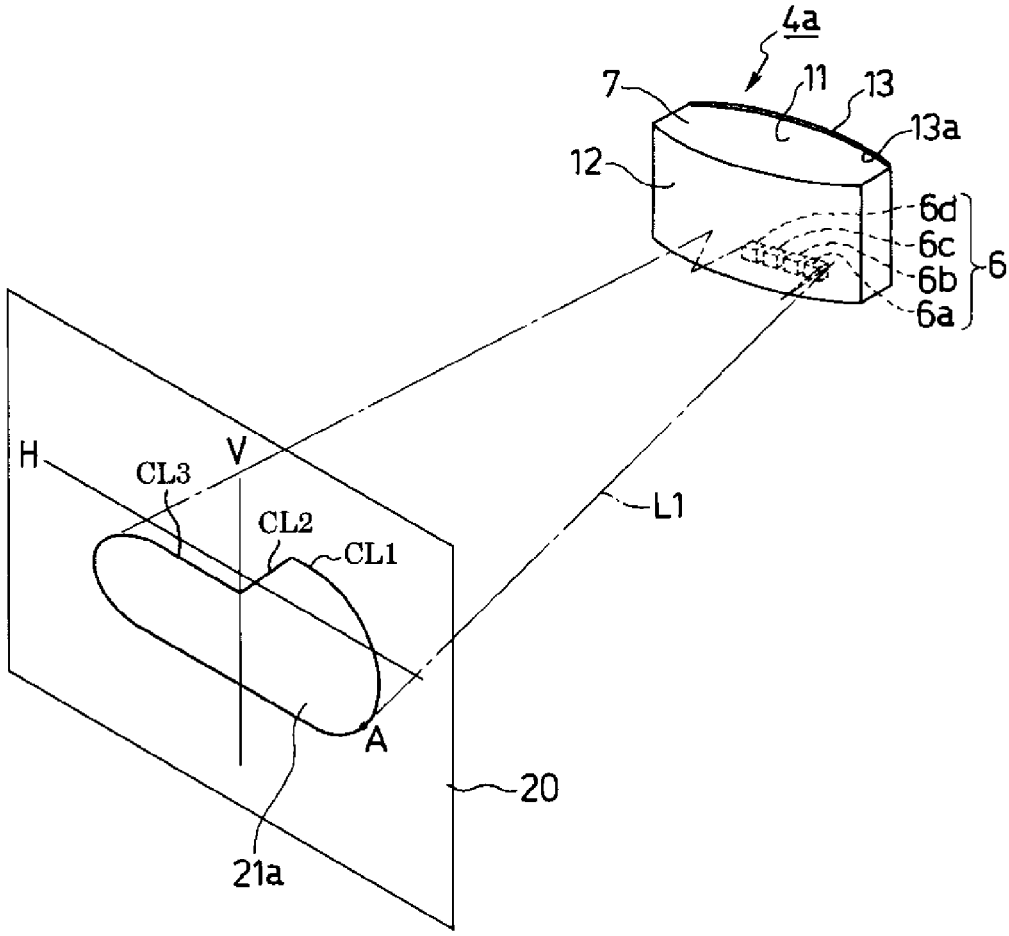
FIG. 4 is a light distribution pattern projected by the optical unit shown in FIG. 3.
Figure 5:
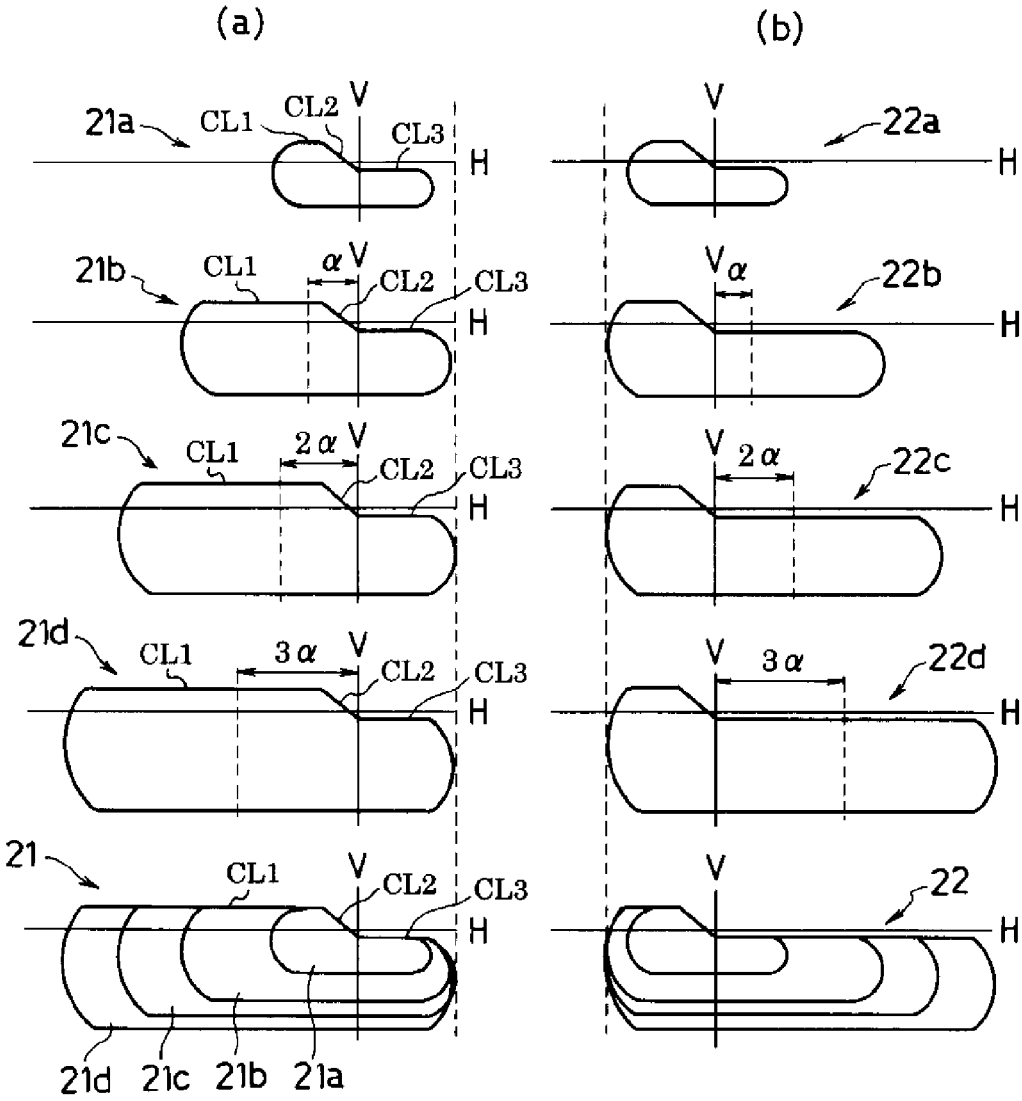
FIGS. 5*a* and 5*b* are exemplary light distribution patterns for left side and right side and for a low beam as viewed from a driver for projector headlights made in accordance with the disclosed subject matter, respectively.
Figure 6:
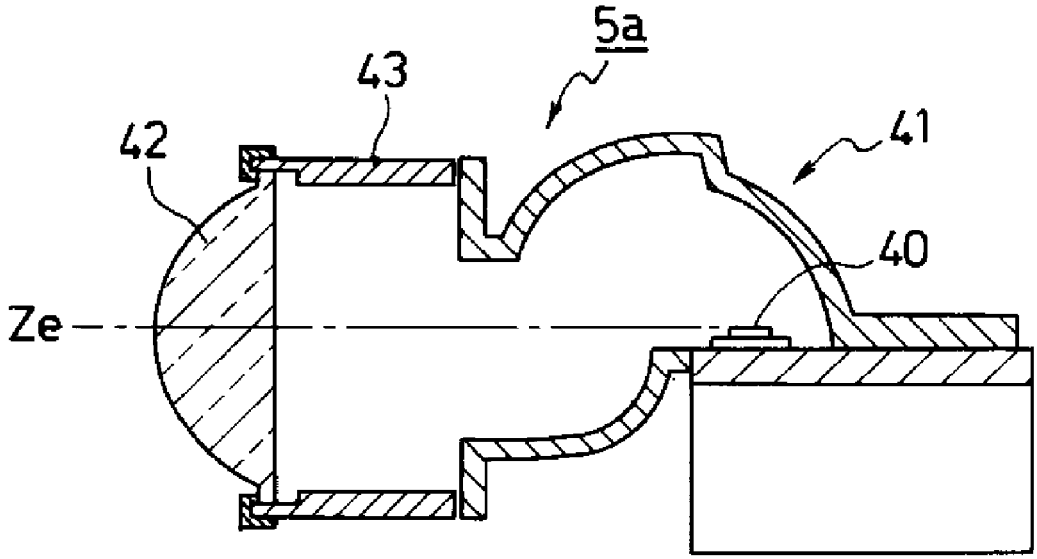
FIG. 6 is a schematic cross-section side view depicting an exemplary optical unit for a high beam.
Figure 7:
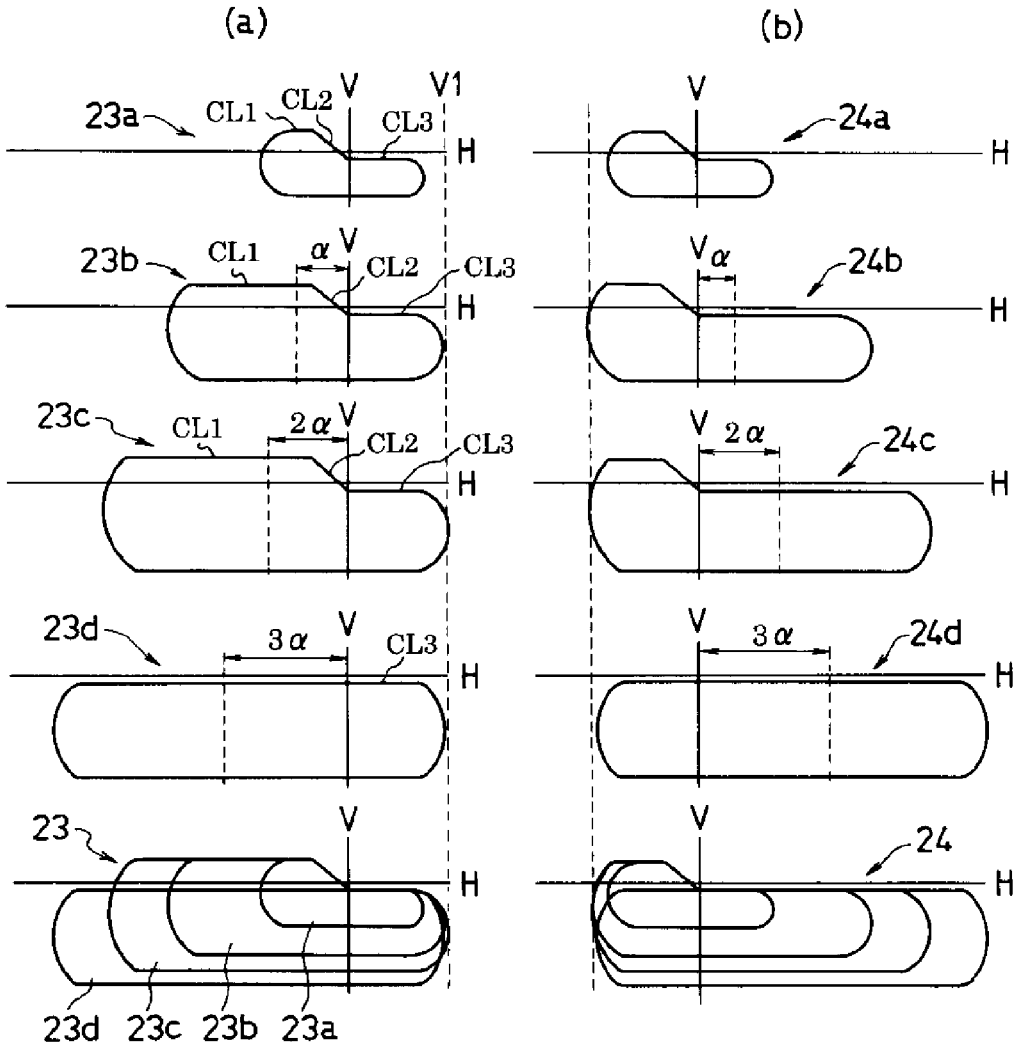
FIGS. 7*a* and 7*b* are other exemplary light distribution patterns for left side and right side and for a low beam as viewed from a driver with respect to a projector headlight made in accordance with the disclosed subject matter, respectively.
Figure 8:
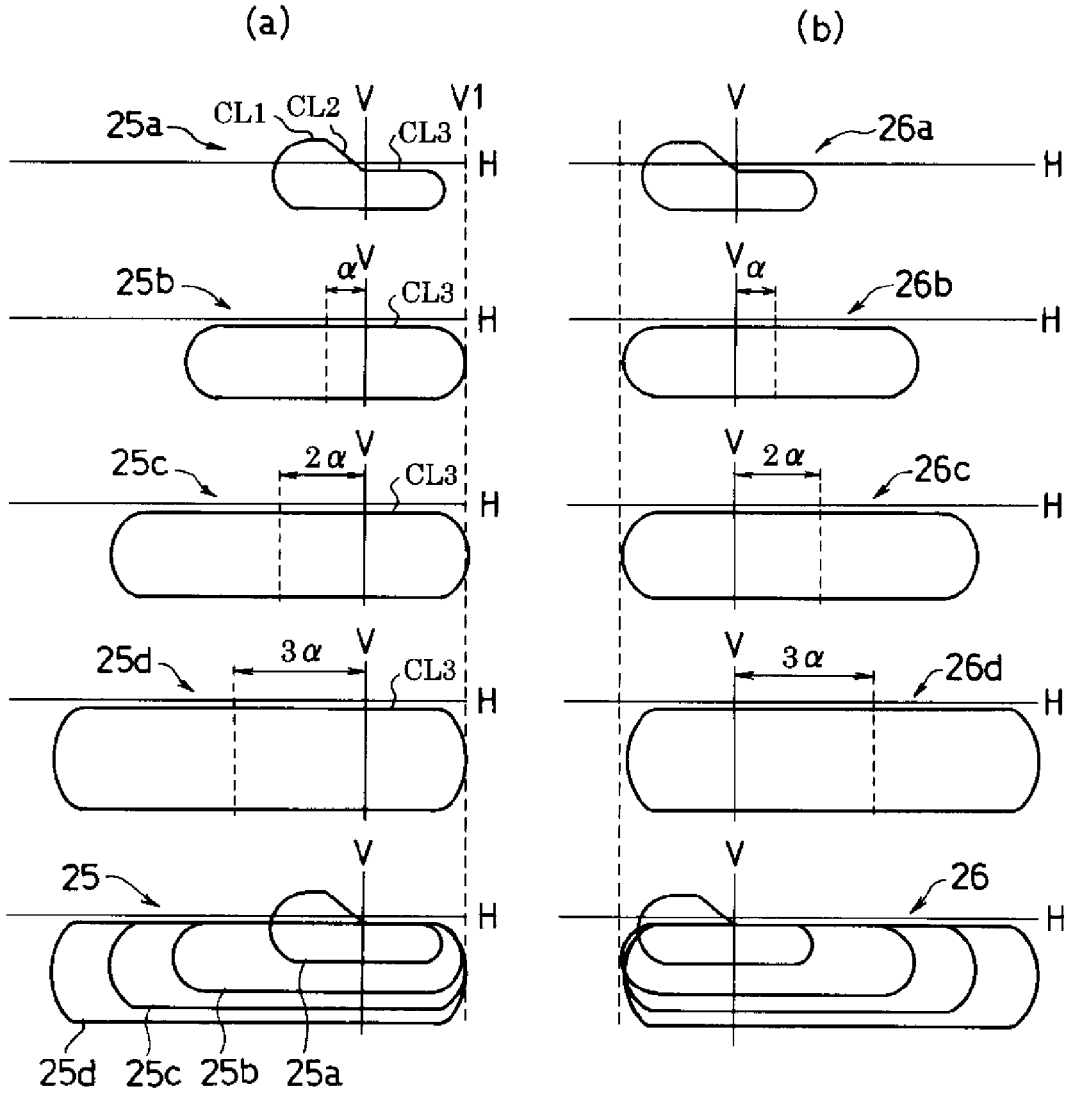
FIGS. 8*a* and 8*b* are others of the other exemplary light distribution patterns for left side and right side and for a low beam as viewed from a driver with respect to a projector headlight made in accordance with the disclosed subject matter, respectively.

A structure of the first optical unit 4*a* and a light distribution pattern formed by the first optical unit 4*a* will now be described with reference to FIGS. 3 and 4. FIG. 3 is an explanatory cross-section view showing the first optical unit 4*a*. FIG. 4 is a light distribution pattern formed by the first optical unit 4*a*, wherein a virtual screen 20 is located vertical to the optical axis Za of the first optical unit 4*a* and is located just twenty five meters from the first optical unit 4*a*.

As shown in FIG. 3, the first optical unit 4*a* can include: the base board; the plurality of LED devices 6*a*-6*d* mounted on the base board so as to align in a direction of a arrow X shown in FIG. 3; and the projector lens 7 having a cavity that is located toward the reflex surface 13*a* thereof and is located in a central portion of the projector lens 7 so as to be exposed to the projector lens 7 from the reflex surface 13*a*, and the projector lens that is located so as to cover the LED devices 6*a*-6*d* with the cavity thereof.

In this case, the X direction of the LED devices 6*a*-6*d* can substantially correspond to the crosswise direction of the convex shape of the projector lens 7, in which each of the curvature factors of the free surfaces 11 and 12 become larger toward both sides of the crosswise direction of the convex shape. In addition, the X direction of the LED devices 6*a*-6*d* can be substantially parallel with a horizontal reference line H shown in FIG. 4, which is a horizontal direction with respect to the light-emission direction of the projector headlight 30.

Here, for example, a ray of light L1 emitted from a point of the LED device 6*a* can enter the projector lens 7 from an incoming surface 14 of the projector lens 7 and can then arrive at the three dimensional free surface 12. When an incoming angle θ of the light ray L1 with respect to the free surface 12 of the projector lens 7 (for which a refraction index is smaller than that of atmosphere) is larger than an optimum angle, the light ray L1 can be reflected on the total reflection surface 12*a* and can move toward the free surface 11.

Then, the light ray L1 can arrive at the reflex surface 13*a* via the free surface 11 and can be reflected on the reflex surface 13*a*. The light ray L1 can move toward the free surface 12 and can be emitted from the light-emitting surface 12*b* while refracting. Accordingly, in a first light distribution pattern 21*a* formed by the first optical unit 4*a* as shown in FIG. 4, a light distribution point A can be formed by the light ray L1.

As described above, in the light path where the light ray L1 that is emitted from the LED device 6*a* enters into the projector lens 7 moves in the projector lens 7 and gets to the prescribed position A on the virtual vertical screen 20, two reflections of the total reflection on the total reflection surface 12*a* of the projector lens 7 and the reflection on the reflex surface 13*a* and one refraction by the light-emitting surface 12*b* of the projector lens 7 are generated. That is to say, the light path of the light ray L1 is controlled by infinitesimal surfaces in which the light ray L1 arrives at the total reflection surface 12*a* and the light-emitting surface 12*b* of the projector lens 7 and the reflex surface 13*a* having the reflecting layer 13.

Thus, the projector lens 7 can be designed by a ray tracing method in order to form the first light distribution pattern 21*a* on the virtual screen 20 by the first optical unit 4*a*. In this case, a light source model can be created according to the LED devices 6*a*-6*d* and light rays can be generated in accordance with a light source model such as a light-emitting area/shape, a light-emitting intensity distribution, etc. Each of the infinitesimal surfaces of the free surfaces 11, 12 can be determined while calculating points where the light rays arrive at the free surfaces 11, 12 so that the light rays can form the first light distribution pattern 21*a* on the virtual vertical screen 20.

Then, the free surfaces 11, 12 can be formed by connecting the respective infinitesimal surfaces that are determined by the calculation and an adjustment based upon the light ray tracing method. For the above-described calculating conditions, the total reflection surface 12*a* and the light-emitting surface 12*b* can be considered the same surface as the free surface 12, and the free surface 11 can be considered the same surface as the reflex surface 13*a* having the reflecting layer 13.

By using the above-described or similar method, the second optical unit 4*b*, the third optical unit 4*c* and the fourth optical unit 4*d* can be designed so that a second light distribution pattern 21*b*, a third light distribution pattern 21*c* and a fourth light distribution pattern 21*d* are formed by the optical units 4*b*-4*d* as shown in FIG. 5*a*, respectively. A light distribution pattern 21 can be formed by these optical units 4*a*-4*d*, that is, by combining respective light distribution patterns 21*a*-21*d*.

When comparing the respective light distribution patterns 21*a*-21*d*, each of the light distribution patterns 21*a*-21*d* can include a horizontal cutoff line CL1 at the driving lane with respect to a vertical reference line V, an elbow line CL2, and a horizontal cutoff line CL3 at the incoming lane. With regard to a light-emitting range in a direction of vehicular width, the fourth light distribution pattern 21*d* formed by the fourth optical unit 4*d* can be the widest and the light-emitting range becomes narrower in order of the third light distribution pattern 21*c*, the second light distribution pattern 21*d* and the first light distribution pattern 21*a*.

That is, the light-emitting range in the direction of vehicular width can become wider in order of the optical unit that is located toward the outside of a vehicle. The light-emitting range can be changed by changing the curvature factor of the free surface 12. The larger the curvature factor of the optical unit is, the wider the light-emitting range of the optical unit is.

Thus, the curvature factors in order of the optical unit that is located toward an outside of a vehicle outside can be configured to be larger.

Each of the optical units 4*a*-4*d* can be located so that adjacent optical units keep a prescribed angle with respect to each other. For example as shown in FIG. 1, the optical axis Za of the first optical unit 4*a* can correspond to the light-emitting direction Z of the projector headlight 30, the optical axis Zb of the second optical unit 4*b* can be configured at an angle αwith respect to the light-emitting direction Z, the optical axis Zc of the third optical unit 4*c* can be configured at an angle 2α and the optical axis Zd of the fourth optical unit 4*d* can be configured at an angle 3α with respect to the light-emitting direction Z. Accordingly, the adjacent optical units can configured at an angle α with respect to each other.

In this case, each of central vertical axes of the light distribution patterns 21*a*-21*d* formed by the respective optical units 4*a*-4*d* can be moved at substantially the same angle with respect to the vertical reference line V according to the above-described locating direction. Each of the central vertical axes of the light distribution patterns 21*b*-21*d* can be located parallel with the vertical reference line V, which corresponds with substantially the central vertical axis of the light distribution pattern 21*a* formed by the first optical unit 4*a*.

In addition, each of the light distribution patterns 21*a*-21*d* can be adjusted so that each of their horizontal cutoff lines CL3 can correspond under the horizontal reference line H in order not to cause a glare toward the incoming lane with respect to the vertical reference line V. That means that when each of the light intensities is measured at an interval of 0.05 degrees on vertical lines of 1.5 degrees, 2.5 degree and 3.5 degrees from the vertical reference line V (0 degree) toward the oncoming lane on the virtual vertical screen 20, each point that is largest in each of the G values measured in the respective light distribution patterns 21*a*-21*d* substantially corresponds.

The G value is used as a definition of the cutoff line and shows a variation of the light intensity on the vertical lines of the virtual vertical screen 20 according to the following formula:

$$G=(\log E_{\beta}-\log E_{(\beta+0.1^{\circ})})$$ where β: Vertical angle (degree).

The larger the G value is, the clearer the cutoff line is.

As described above, the light distribution pattern 21 for the low beam can be formed by combining the respective light distribution patterns 21*a*-21*d*, which are formed by the respective optical units 4*a*-4*d*. In the light distribution patterns 21*a*-21*d* for the low beam, the second light distribution pattern 21*b* formed by the second optical unit 4*b* can be formed so as to cover the first light distribution pattern 21*a* formed by the first optical unit 4*a*. The third light distribution pattern 21*c* formed by the third optical unit 4*c* can be formed so as to cover the second light distribution pattern 21*b* formed by the second optical unit 4*b*. In addition, the fourth light distribution pattern 21*d* formed by the fourth optical unit 4*d* can be formed so as to cover the third light distribution pattern 21*c* therewith.

Thus, because a driver may not recognize a light-dark difference due to a difference between the light-emitting ranges emitted from the respective optical units 4*a*-4*d*, the disclosed subject matter can provide a projector headlight having a wide light-emitting range and a high visibility for a driver. In addition, each of the respective light distribution patterns 21*a*-21*d* can include the horizontal cutoff line CL1 and the elbow line CL2 on the driving lane with respect to the vertical reference line V and the horizontal cutoff line CL3 on the oncoming lane, and their cutoff lines CL1-CL3 can correspond to substantially the same line. Thus, the light distribution pattern 21 for the low beam that is composed of the respective light distribution patterns 21*a*-21*d* can form clear cutoff lines CL1-CL3. In particular, the cutoff line CL3 on the oncoming lane can be clearly located on the prescribed horizontal line, and therefore the disclosed subject matter can realize a projector headlight having a favorable light distribution pattern without substantial glare.

The fifth optical unit 5*a* that is used as the high beam optical unit 5 can be a projector type optical unit similar to the optical units 4*a*-4*d*. As show in FIG. 6, the fifth optical unit 5*a* can include: an ellipsoidal reflector 41 having a first focus and a second focus; a light source 40 located at the first focus of the ellipsoidal reflector 41; a projector lens 42 having a first focus that is located at the second focus of the ellipsoidal reflector 41; and a lens holder 43 fixing the projector lens 42 with respect to the ellipsoidal reflector 41.

Therefore, light emitted from the light source 40 can be focused at the first focus of the projector lens 42 via the ellipsoidal reflector 41 and can be emitted in a direction toward the light-emission of the projector headlight 30 via the projector lens 42 while forming a light distribution pattern for a high beam. The fifth optical unit 5*a* can be located closer to a central line of a vehicle than the location of the optical units 4*a*-4*d*, and the optical axis Ze of the fifth optical unit 5*a* can substantially correspond to the light-emitting direction Z of the projector headlight 30 as shown in FIG. 1. The fifth optical unit 5*a* can also be made by the same structure as the optical units 4*a*-4*d*. In this case, the optical unit 5*a* can be thinner than the structure shown in FIG. 6.

FIG. 5*b* shows light distribution patterns formed by the projector headlight located at a right side of a vehicle in view of a driver (for left side of road driving conditions). A projector headlight of the right side can be basically symmetrical to the above-described projector headlight 30. Therefore, a light distribution pattern 22 formed by the projector headlight for a low beam can be formed by combining respective light distribution patterns 22*a*-22*d* as similar to formation of the light distribution pattern 21.

FIGS. 7*a* and 7*b* depict other exemplary light distribution patterns of a left side and a right side for a low beam that are viewed from a driver with respect to a projector headlight made in accordance with the disclosed subject matter, respectively. A difference between this embodiment and the above-described embodiment is a shape of the projector lens 7 in the optical unit 4*d*. A light distribution pattern 23 formed by this embodiment can be formed by combining respective light distribution patterns 23*a*-23*d* emitted from optical units in this embodiment.

In this embodiment, the respective light distribution patterns 23*a*-23*c* can include the elbow lines CL2. However, the light distribution pattern 23*d* does not include the elbow line CL2. In this case, the respective elbow lines CL2 in the light distribution patterns 23*a*-23*c* can be located on substantially the same line. The respective horizontal cutoff lines CL1 in the light distribution patterns 23*a*-23*c* can be located on substantially the same line. The respective horizontal cutoff lines CL3 in the light distribution patterns 23*a*-23*d* can be located on substantially the same line.

Thus, the low beam light distribution pattern 23 that is composed of respective light distribution patterns 23*a*-23*d* can have clear cutoff lines CL1-CL3. In particular, the cutoff line on the oncoming lane can be clearly located on the prescribed horizontal line, and therefore the disclosed subject matter can realize a projector headlight having a favorable light distribution pattern without substantial glare. In addition, each of the light distribution patterns 23*a*-23*d* can be formed so that a central vertical axis thereof can associate with substantially the same angle with respect to the optical axis of the adjacent optical unit in turn from the first optical unit 4*a*. Therefore, the above-described embodiment can also provide a project headlight having a wide light distribution such as the light distribution pattern 23.

FIG. 7*b* shows a light distribution pattern formed by a projector headlight located at a right side of a vehicle in view of a driver. The projector headlight of the right side can be basically symmetrical to the above-described projector headlight, and therefore the light distribution pattern 24 formed by the low beam projector headlight can be formed by combining respective light distribution patterns 24*a*-24*d* similar to formation of the light distribution pattern 23.

FIGS. 8*a* and 8*b* are other exemplary light distribution patterns of a left side and a right side for a low beam that are viewed from a driver with respect to a projector headlight made in accordance with the disclosed subject matter, respectively. A difference between this embodiment and the immediately above-described embodiment is a shape of the projector lenses 7 in the optical units 4*b*-4*c*. A light distribution pattern 25 formed by this embodiment can be formed by combining respective light distribution patterns 25*a*-25*d* emitted from optical units in this embodiment.

Specifically, the light distribution pattern 25*a* can include the elbow line CL2. However, the light distribution patterns 25*b*-25*d* do not include the elbow line CL2. The first optical unit 4 forming the light distribution pattern 25*a* can be located closer to the central line of a vehicle than the other optical units, and the optical axis Za thereof can be located in substantially the same direction as the light-emitting direction Z of the projector headlight 30. Therefore the optical unit 4*a* can emit light with high brightness on a narrow area. Thus, this embodiment can improve visibility on a far place and also can form a Z pattern (a pattern formed by the cutoff lines CL1, CL2 and CL3).

In addition, each of the light distribution patterns 25*a*-25*d* can be adjusted so that each of their horizontal cutoff lines CL3 can correspond under the horizontal reference line H. Here, that means that when each of light intensities are measured at an interval of 0.05 degrees on vertical lines of 1.5 degrees, 2.5 degree and 3.5 degrees from the vertical reference line V (0 degree) toward the oncoming lane on the virtual vertical screen 20, each point that is largest of each of the G values measured in the respective light distribution patterns 25*a*-25*d*, substantially corresponds or is coincident with each other.

Thus, the respective horizontal cutoff lines CL3 can be located on substantially the same line and can be clearly formed as a low beam in the light distribution pattern 25 that is composed of the light distribution patterns 25*a*-25*d*. In particular, the cutoff line CL3 on the oncoming lane can be clearly located on the prescribed horizontal line, and therefore this embodiment of the disclosed subject matter can realize a projector headlight having a favorable light distribution pattern without substantial glare. Furthermore, each of the light distribution patterns 25*a*-25*d* can be formed so that a central vertical axis thereof can associate with substantially the same angle with respect to the optical axis of the adjacent optical unit in turn from the first optical unit 4*a*. Therefore, the above-described embodiment can also provide a projector headlight having a wide light distribution such as shown in the light distribution pattern 25.

FIG. 8*b* shows a light distribution pattern formed by a projector headlight located at a right side of a vehicle in view of a driver. The projector headlight of the right side can be basically symmetrical to the above-described projector headlight, and therefore the light distribution pattern 26 formed by the projector headlight for a low beam can be formed by combining respective light distribution patterns 26*a*-26*d* similar to formation of the light distribution pattern 25.

In the above-described embodiments, the projector headlight 4 for a low beam can be constructed from the four optical units. However, the projector headlight is not limited to such a structure and can be realized by being constructed from a plurality of optical units. In addition, all the light distribution patterns formed by theses optical units need not necessarily include the elbow line CL3. If at least one of the light distribution patterns includes the elbow line CL3, the projector headlight 4 can conform to a light distribution standard for a low beam.

Figure 9:
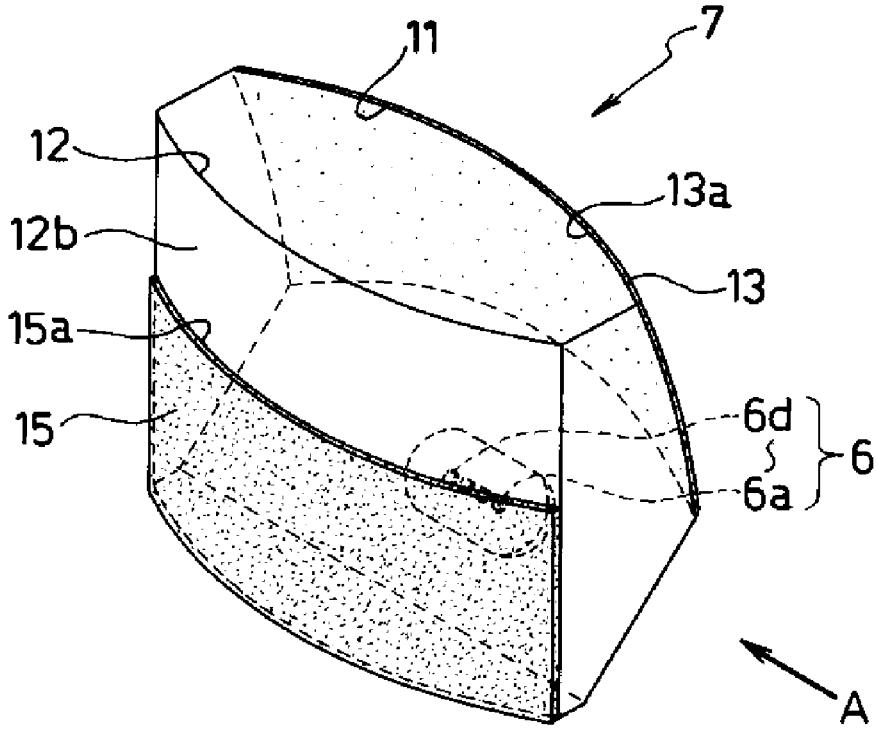
FIG. 9 is an explanatory perspective view showing another exemplary optical unit used in the projector headlight of FIG. 1.
Figure 10:
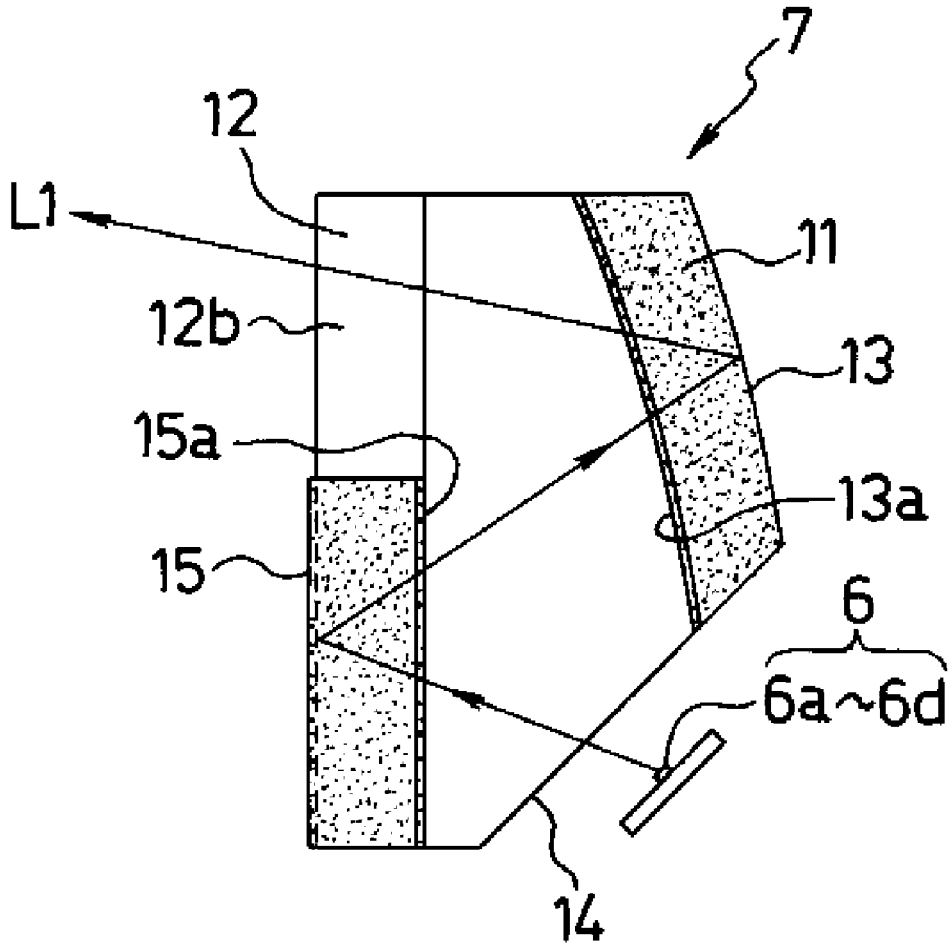
FIG. 10 is a side view depicting a structure and a light ray in the optical unit viewed from arrow A shown in FIG. 9.
Figure 11:
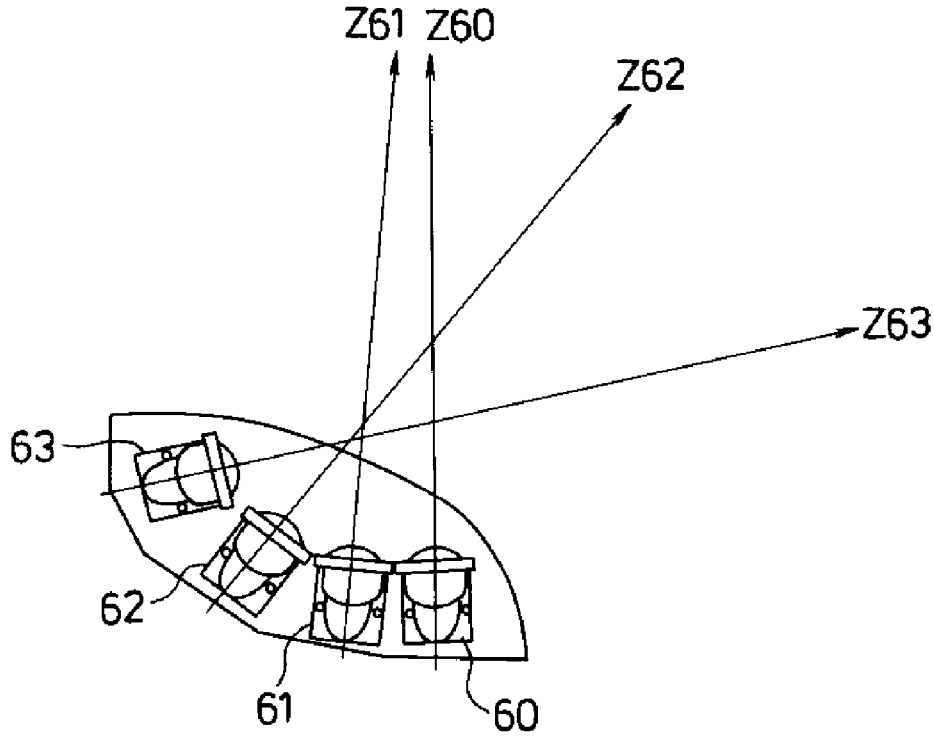
FIG. 11 CONVENTIONAL ART
FIG. 11 is a schematic cross-section view showing a first conventional headlight.
Figure 12:
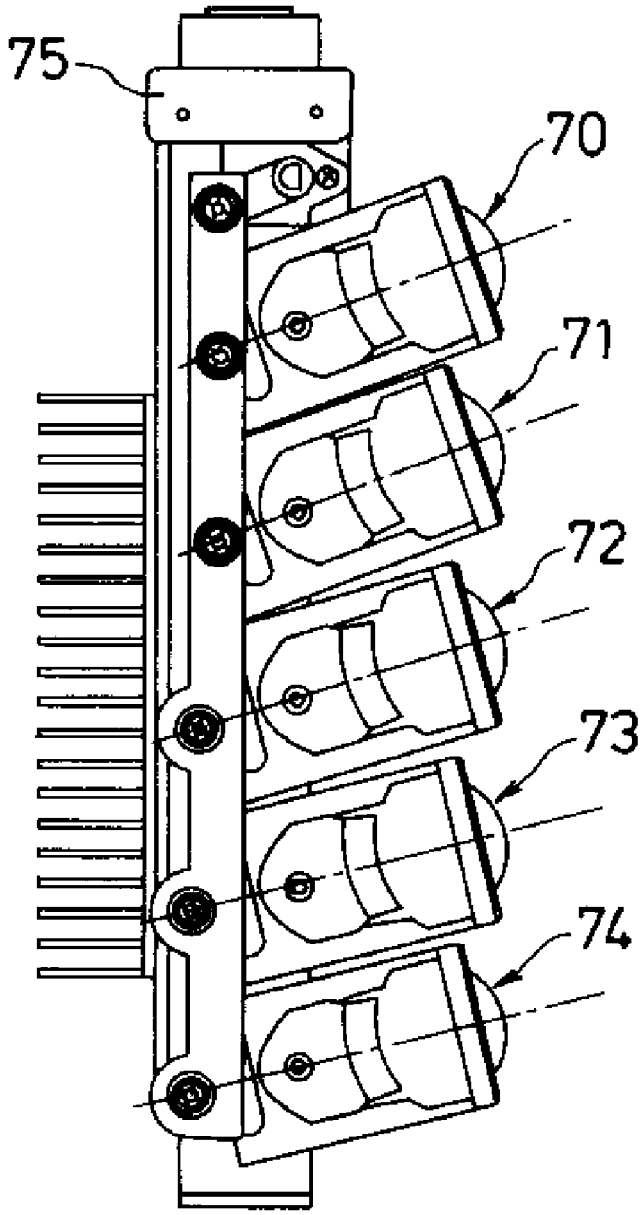
FIG. 12 CONVENTIONAL ART
FIG. 12 is a partial explanatory view depicting a second conventional headlight.
Figure 13:
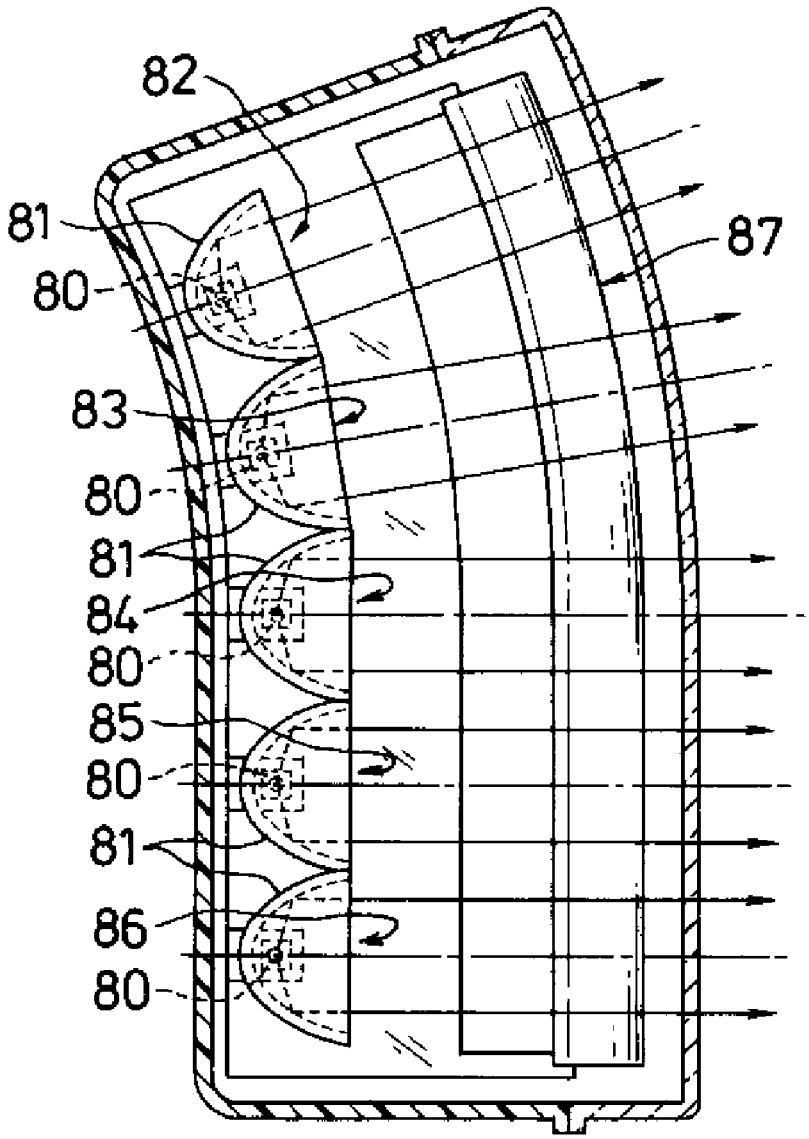
FIG. 13 CONVENTIONAL ART
FIG. 13 is a cross-section view showing a third conventional headlight.
Figure 14:
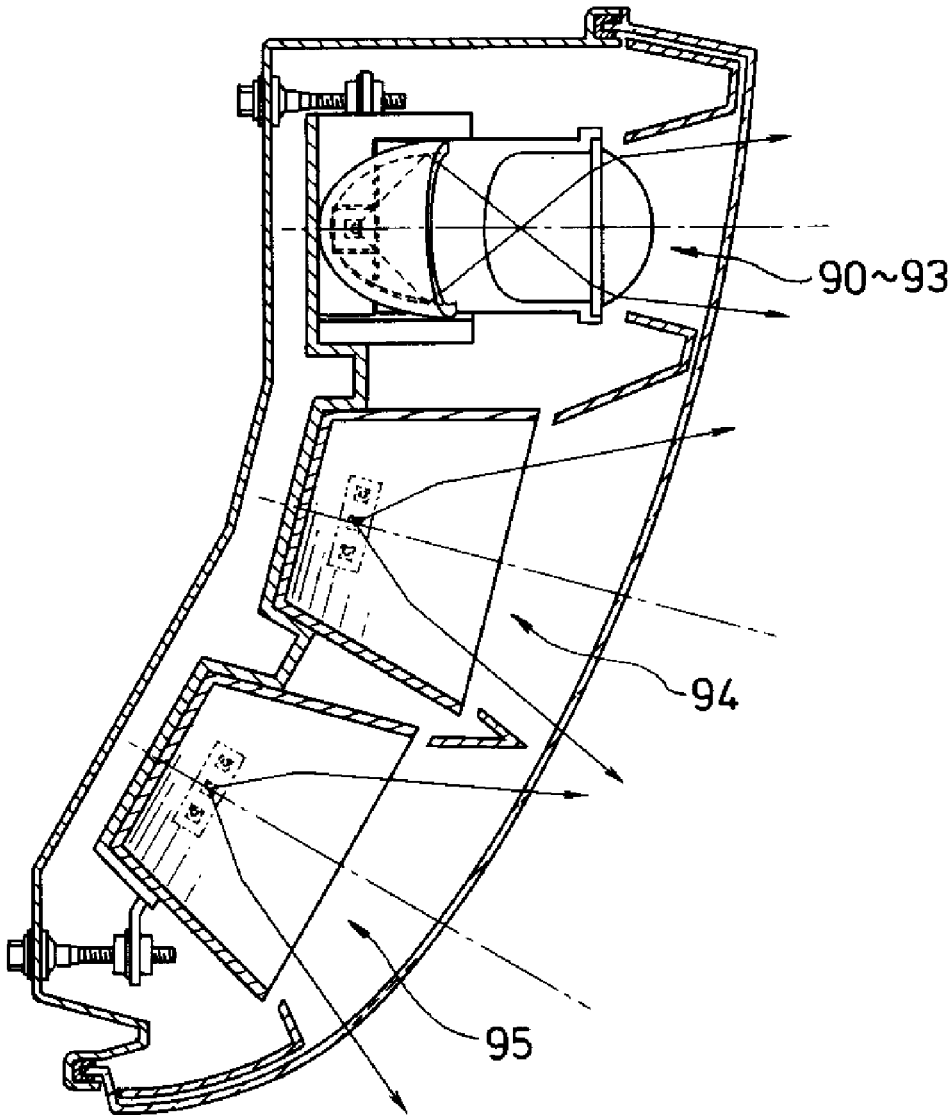
FIG. 14 CONVENTIONAL ART
FIG. 14 is a cross-section view showing a fourth conventional headlight.
Figure 15:
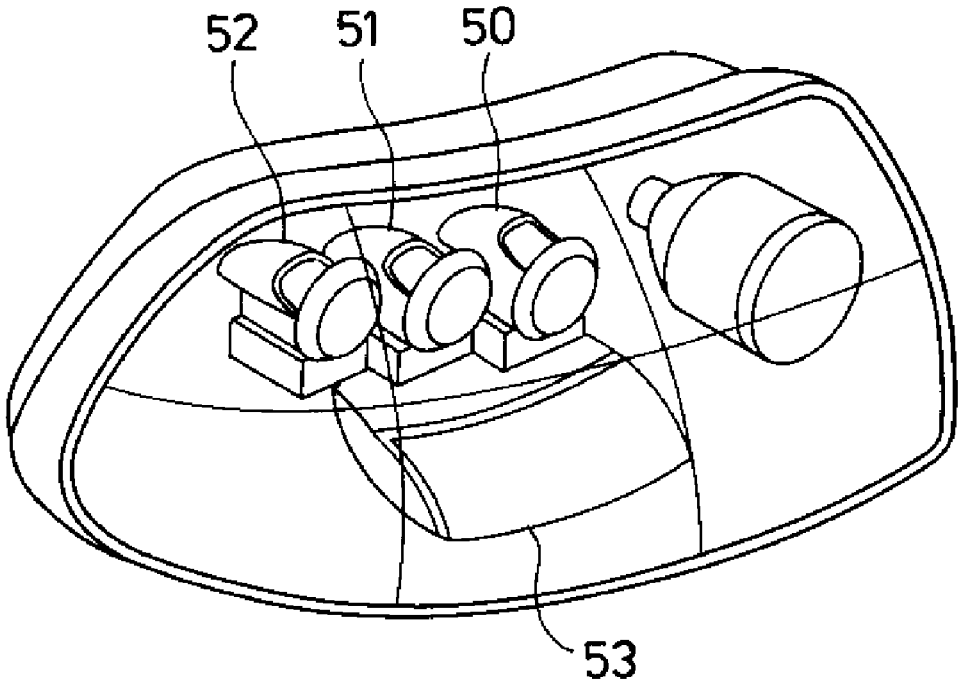
FIG. 15 CONVENTIONAL ART
FIG. 15 is a perspective view showing a fifth conventional headlight.

In the projector lens 7 of the optical units 4*a*-4*d*, the projector lens 7 is not limited to the above-described structure and can be configured with various different shapes and structures. FIG. 9 is an explanatory perspective view showing another exemplary optical unit that can be used in the projector headlight 4 in FIG. 1. FIG. 10 is a side view depicting a structure and a light ray in the optical unit that is viewed from an arrow A shown in FIG. 9. The projector lens 7 can include three dimensional free surfaces 11 and 12 that are opposite with respect to each other and are curved outward in convex shapes. On the free surface 11, a reflex surface 13*a* having a reflecting layer 13 can be formed, and the reflecting layer 13 can include a reflex material such as aluminum or the like that can be formed or deposited by a method such as a deposition method.

The free surface 12 can include two separate optical functional surfaces such as a reflex surface 15*a* having a reflecting layer 15 as well as a reflecting layer 13 and a light-emitting surface 12*b*. In this case, each of the curvature factors of these free surfaces 11, 12 can also become larger toward both sides in the crosswise direction of the convex shapes, and therefore the respective curvature factors of the free surfaces 11, 12 can become larger in the same direction.

The light source 6 including the LED devices 6*a*-6*d* can be located adjacent to the projector lens 7 so that the LED devices 6*a*-6*d* face the incoming surface 14 of the projector lens 7, and the light ray L1 emitted from the light source 6 can enter into the projector lens 7. The light ray L1, for example, can be reflected on the reflex surface 15*a* and on the reflex surface 13*a*, and can be emitted from the light-emitting surface 12*b* in a direction toward light-emission of the projector headlight 30. That is, the projector lens 7 can be configured to replace the total reflection surface 12*a* of the projector lens 7 with the reflex surface 15*a*. Therefore, the method for the surface formation of the projector lens 7 of this embodiment can be the same as for the above-described previous embodiment of the projector lens 7.

In the method for the surface formation of the projector lens 7, when each of the optical exes of the optical units 4*a*-4*d* can correspond to the same surface that is parallel with the horizontal reference line H, the projector lens 7 can be easy to form and each of the projector lenses 7 in the optical units 4*a*-4*d* may be easily formed in a similar shape, because the light ray path characteristics in each of the optical units 4*a*-4*d* are similar. Similarly, when each of the X directions of the light-emitting devices 6*a*-6*d* in each of the optical units 4*a*-4*d* can correspond to the same surface that is parallel with the horizontal reference line H, the projector lens 7 can be easy to form and each of the projector lenses 7 in the optical units 4*a*-4*d* may be easily formed in a similar shape.

In addition, the three dimensional free surfaces 11 and 12 of the projector lens 7 may not always be formed in free surfaces base upon a spline curve, Bezier surface, etc. For example, when a simple pattern such as the light distribution pattern 23*d* shown in FIG. 7*a* can be formed under a good condition such as the above-described optical axis and the X direction, the optical unit 4*d* may be formed by a composite surface based on other surfaces such as an elliptical surface, a parabolic surface, etc.

As described above, the disclosed subject matter can provide projector headlights for a low beam using a plurality of optical units and provided with a plurality of light-emitting semiconductor devices and a projector lens. The projector headlights can form various favorable light distribution patterns by changing the curvature factors of the three dimensional free surfaces that include the light-emitting surface, the total reflection surface and reflex surface of the projector lens in each of the optical units, which are located so that the angles between the respective optical axes of the adjacent optical units with each other can become substantially a same angle.

As a result, the projector headlight can allow the optical units to decrease in thickness and can allow the plurality of optical units to be located at a narrow interval and with a wide angle. Thus, the projector headlight can emit light with a high light intensity and a wide range while maintaining a thin and small projector type. In addition, because the plurality of optical units can be formed in a similar shape and can be regularly located in a small space, the projector headlight can result in increasing the possibility of headlight design and a high visual quality.

Furthermore, the optical unit located toward the central line of a vehicle can emit light having a high intensity and a narrow range and the optical unit located toward the outside of a vehicle can emit light with a wide range so as to overlap the bright light distribution pattern while forming the clear cutoff lines without substantial glare. Thus, the disclosed subject matter can provide projector headlights for a low beam having a favorable light distribution pattern and a high visual/visible quality.

Various modifications of the above disclosed embodiments can be made without departing from the spirit and scope of the presently disclosed subject matter. For example a headlight for a low beam can be structured by a plurality of small projector headlights using the above-described structure, which have respective different light distribution patterns.

While there has been described what are at present considered to be exemplary embodiments of the invention, it will be understood that various modifications may be made thereto, and it is intended that the appended claims cover such modifications as fall within the true spirit and scope of the invention. All conventional art references described above are herein incorporated in their entirety by reference.

What is claimed is:

1. A projector headlight, comprising:

a plurality of optical units including a first optical unit, a second optical unit and a third optical unit, each of the optical units including an optical axis, a light source and a projector lens, the projector lens having a light-emitting surface including a total reflection surface and a reflex surface including a light incoming surface, the light-emitting surface including the total reflection surface and the reflex surface, and the total reflection surface and the reflex surface being located opposite with respect to each other and each being curved in a convex shape having curvature factors, the light source including a plurality of light-emitting semiconductor devices and a base board such that the plurality of light-emitting devices are configured in line on the base board, the light source located adjacent to the light incoming surface of the projector lens so that the light-emitting semiconductor devices face the light incoming surface substantially in a horizontal direction with respect to a light-emission direction of the projector headlight, the first optical unit located so that an optical axis of the first optical unit is directed substantially in a direction parallel with the light-emission direction of the projector headlight, the second optical unit located adjacent to the first optical unit so that an optical axis of the second optical unit is slanted at a first angle with respect to the optical axis of the first optical unit in an opposite direction of the first optical unit and substantially in a horizontal direction with respect to the light-emission direction of the projector headlight, the third optical unit located adjacent to the second optical unit so that an optical axis of the third optical unit is slanted at a second angle with respect to the optical axis of the second optical unit in the opposite direction of the second optical unit and substantially in a horizontal direction with respect to the light-emission direction of the projector headlight, and wherein the curvature factors in a horizontal direction with respect to the light-emission direction of the projector headlight of the light-emitting surface including the total reflection surface and the reflex surface of the projector lens in the first optical unit are smaller than the curvature factors in a horizontal direction with respect to the light-emission direction of the projector headlight of the light-emitting surface including the total reflection surface and the reflex surface of the projector lens in the second optical unit, and the curvature factors in a horizontal direction with respect to the light-emission curvature of the projector headlight of the light-emitting surface including the total reflection surface and the reflex surface of the projector lens in the second optical unit are smaller than the curvature factors in a horizontal direction with respect to the light-emission direction of the projector headlight of the light-emitting surface including the total reflection surface and the reflex surface of the projector lens in the third optical unit.

2. The projector headlight according to claim 1, wherein the first angle between the optical axis of the first optical unit and the optical axis of the second optical unit is the same as the second angle between the optical axis of the second optical unit and the optical axis of the third optical unit.

3. The projector headlight according to claim 1, wherein each of the optical axis of the first optical unit, the optical axis of the second optical unit and the optical axis of the third optical unit is located substantially on a same virtual horizontal surface.

4. The projector headlight according to claim 2, wherein each of the optical axis of the first optical unit, the optical axis of the second optical unit and the optical axis of the third optical unit is located substantially on a same virtual horizontal surface.

5. The projector headlight according to claim 1, wherein each light-emitting device of the light source in the first optical unit, the second optical unit and the third optical unit is located substantially on a same virtual horizontal surface.

6. The projector headlight according to claim 2, wherein each light-emitting device of the light source in the first optical unit, the second optical unit and the third optical unit is located substantially on a same virtual horizontal surface.

7. The projector headlight according to claim 3, wherein each light-emitting device of the light source in the first optical unit, the second optical unit and the third optical unit is located substantially on a same virtual horizontal surface.

8. The projector headlight according to claim 4, wherein each light-emitting device of the light source in the first optical unit, the second optical unit and the third optical unit is located substantially on a same virtual horizontal surface.

9. The projector headlight according to claim 1, wherein at least one of the light-emitting surface, the total reflection surface and the reflex surface in each projector lens in the first optical unit, the second optical unit and the third optical unit includes a three dimensional free surface.

10. The projector headlight according to claim 2, wherein at least one of the light-emitting surface, the total reflection surface and the reflex surface in each projector lens in the first optical unit, the second optical unit and the third optical unit includes a three dimensional free surface.

11. The projector headlight according to claim 3, wherein at least one of the light-emitting surface, the total reflection surface and the reflex surface in each projector lens in the first optical unit, the second optical unit and the third optical unit includes a three dimensional free surface.

12. The projector headlight according to claim 4, wherein at least one of the light-emitting surface, the total reflection surface and the reflex surface in each projector lens in the first optical unit, the second optical unit and the third optical unit includes a three dimensional free surface.

13. The projector headlight according to claim 5, wherein at least one of the light-emitting surface, the total reflection surface and the reflex surface in each projector lens in the first optical unit, the second optical unit and the third optical unit includes a three dimensional free surface.

14. The projector headlight according to claim 6, wherein at least one of the light-emitting surface, the total reflection surface and the reflex surface in each projector lens in the first optical unit, the second optical unit and the third optical unit includes a three dimensional free surface.

15. The projector headlight according to claim 7, wherein at least one of the light-emitting surface, the total reflection surface and the reflex surface in each projector lens in the first optical unit, the second optical unit and the third optical unit includes a three dimensional free surface.

16. The projector headlight according to claim 1, wherein the projector headlight is configured as a low beam headlight for a vehicle.

17. A vehicle lamp including the projector headlight according to claim 16, further comprising:

a housing;

a second projector headlight, the second projector headlight configured as a high beam headlight for a vehicle and attached to the housing; and an outer lens located adjacent to the housing.

18. A vehicle lamp including the projector headlight according to claim 2, further comprising:

a housing;

a second projector headlight, the second projector headlight configured as a high beam headlight for a vehicle and attached to the housing; and an outer lens located adjacent to the housing, wherein the projector headlight is configured as a low beam headlight for a vehicle.

19. A vehicle lamp including the projector headlight according to claim 3, further comprising:

a housing;

a second projector headlight, the second projector headlight configured as a high beam headlight for a vehicle and attached to the housing; and an outer lens located adjacent to the housing, wherein the projector headlight is configured as a low beam headlight for a vehicle.

20. The vehicle lamp according to claim 17, wherein each of the projector headlight and second projector headlight includes an LED light source.

* * * * *